US005821487A

United States Patent [19]

Groves et al.

[11] Patent Number: 5,821,487

[45] Date of Patent: Oct. 13, 1998

[54] LOCK OUT MECHANISM FOR CIRCUIT BREAKER HANDLE OPERATOR

[75] Inventors: David H. Groves, Beaver Falls; Thomas T. Kuzniarski, Coraopolis, both of Pa.

[73] Assignee: Eaton Corporation, Cleveland, Ohio

[21] Appl. No.: 715,556

[22] Filed: Sep. 19, 1996

[51] Int. Cl.[6] ..... H01H 9/20

[52] U.S. Cl. ..... 200/50.02; 200/50.19

[58] Field of Search ..... 200/50.01, 50.02–50.09, 200/50.12–50.19, 43.01–43.22, 330, 17 R

[56] References Cited

U.S. PATENT DOCUMENTS

| | | | |
|---|---|---|---|
| 2,695,934 | 11/1954 | Wills | 200/50.19 |
| 3,171,908 | 3/1965 | Malota | 200/50.18 |
| 3,848,102 | 11/1974 | Jencks et al. | 200/50.05 X |
| 3,970,808 | 7/1976 | Gryctko et al. | 200/50.15 |
| 4,835,350 | 5/1989 | Ozu et al. | 200/50.12 |
| 4,851,621 | 7/1989 | Borchardt et al. | 200/50.05 |
| 5,302,925 | 4/1994 | Castonguay et al. | 200/330 |
| 5,493,084 | 2/1996 | Whitaker et al. | 200/50.05 |

OTHER PUBLICATIONS

Instructions for Vari–Depth Operating Mechanisms for Types EB, EHB, FB and F–Frame Series C Circuit Breakers, and Type HMCP (Sizes 0–4) Motor Circuit Protectors, Westinghouse I.L. 13698–F, Feb. 1992.

*Primary Examiner*—J. R. Scott

*Attorney, Agent, or Firm*—Martin J. Moran

[57] ABSTRACT

The handle operator for a circuit breaker mounted in an enclosure is locked in the OFF position when the enclosure is opened by a lock-out member which directly engages the operator member of the handle operator which contacts and moves the circuit breaker handle. The lock-out member is a metal plate having an engagement edge which is positioned transverse to an engagement edge of the metal plate forming the handle operator member. Preferably, the lock-out member plate has a slot in which the engagement edge of the operator plate is received. The operator plate is pivotally mounted for rotation in its own plane and the lock-out plate slides parallel to the operator plate and has a flange providing the engagement edge which engages the operator plate at a point where any attempt to rotate the operator plate to move the circuit breaker handle toward the ON position, jams the lock-out plate into tighter contact with the operator plate. Preferably, the flange of the lock-out plate is bent at an angle which places it perpendicular to the engagement edge of the operator plate when engaged.

10 Claims, 5 Drawing Sheets

LOCK OUT MECHANISM FOR CIRCUIT BREAKER HANDLE OPERATOR

BACKGROUND OF THE INVENTION

1. Field of the Invention

This invention relates to circuit breakers mounted in an enclosure for operation from outside the enclosure by a handle operating mechanism. More particularly, it relates to a lock out mechanism for securing the circuit breaker handle in the off position when the enclosure is open.

2. Background Information

In many applications, a circuit breaker is mounted in an enclosure and is provided with a mechanical handle operator by which the circuit breaker may be opened and closed from outside of the enclosure. In a common arrangement, the handle operator includes a plate engaging the circuit breaker handle mounted for rotation by a shaft offset laterally from and extending perpendicular to the generally linear path along which the circuit breaker handle reciprocates. The shaft extends through the enclosure and has a secondary handle on the outside which is rotated to open and close the circuit breaker.

When the enclosure is opened, safety considerations call for the operator to be able to lock the handle in the off position. It is known to have a planar lock-out member mounted for sliding parallel to and over the operator plate to directly engage the circuit breaker handle and block its movement out of the off position. However, often the circuit breaker handle does not extend very far above the rotating plate of the handle operator so that it is possible for the handle to slide under the lock-out plate if sufficient force is applied. In other cases, the handles which are now made of a resinous material which is softer than the previously used handle materials can be cut by the metal lock-out plate such that the handle can still be moved to an unsafe position despite the lock-out mechanism.

There is a need therefore for an improved lock-out mechanism for a circuit breaker mounted in an enclosure and operated externally by a handle operator.

There is a need for such a mechanism which cannot be defeated by application of a force sufficient to cause the handle to slide under the lock-out plate or to cause the edge of the lock-out plate to cut through the handle.

There is a further need for such a lock-out mechanism which is simple, reliable and requires minimum modification to existing lock-out mechanisms.

SUMMARY OF THE INVENTION

These needs and others are satisfied by the invention which is directed to a lock-out mechanism in which the lock-out member directly engages and blocks movement of the operating member engaging the circuit breaker handle. Preferably the operating member is a first plate member mounted by first mounting means for reciprocal movement in the plane of the first plate member, and the lock-out member is a second plate member which is mounted by second mounting means which supports the second plate member generally transverse to the first plate member in the engaged position with respective engagement edges of the two plate members in contact to block movement of the first plate member and, therefore, the circuit breaker handle.

Also, preferably, one of the engagement edges is defined by a slot in which the engagement edge of the other plate member is received when the lock-out member is in the engaged position. In the particularly preferred embodiment of the invention, this slot is in the second plate member which forms the lock-out member.

In the exemplary embodiment invention, the second plate member has a first generally planar section and a second generally planar section, the latter of which defines the engagement edge. The second generally planar section is generally transverse to the first planar section. The second mounting means mounts the second plate member for reciprocal movement of the first generally planar section generally parallel to the first plate member.

Preferably, the first mounting means mounts the first plate member for reciprocal rotation in the plane of the first plate member about a pivot axis which is offset laterally from the generally linear path along which the circuit breaker handle is reciprocated. The second mounting means mounts the second plate so that the engagement edges on the two plates engage at a point where any attempt to rotate the first plate member to move the circuit breaker handle toward the on position pulls the second plate member of the lock-out means into tighter engagement.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
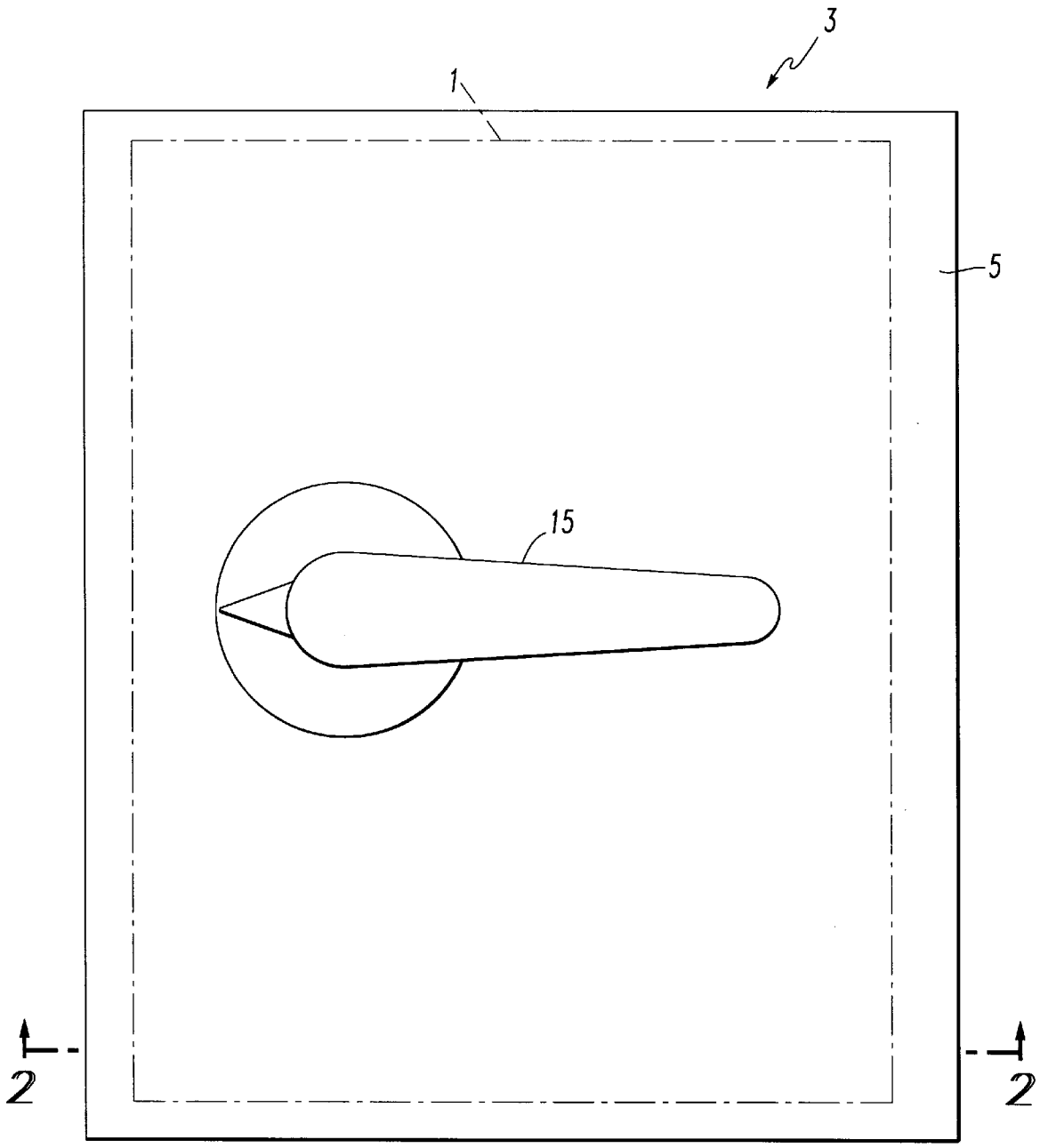
FIG. 1 is a plan view of an enclosure housing a circuit breaker incorporating a handle operating mechanism with a lock-out mechanism in accordance with the invention.
Figure 2:
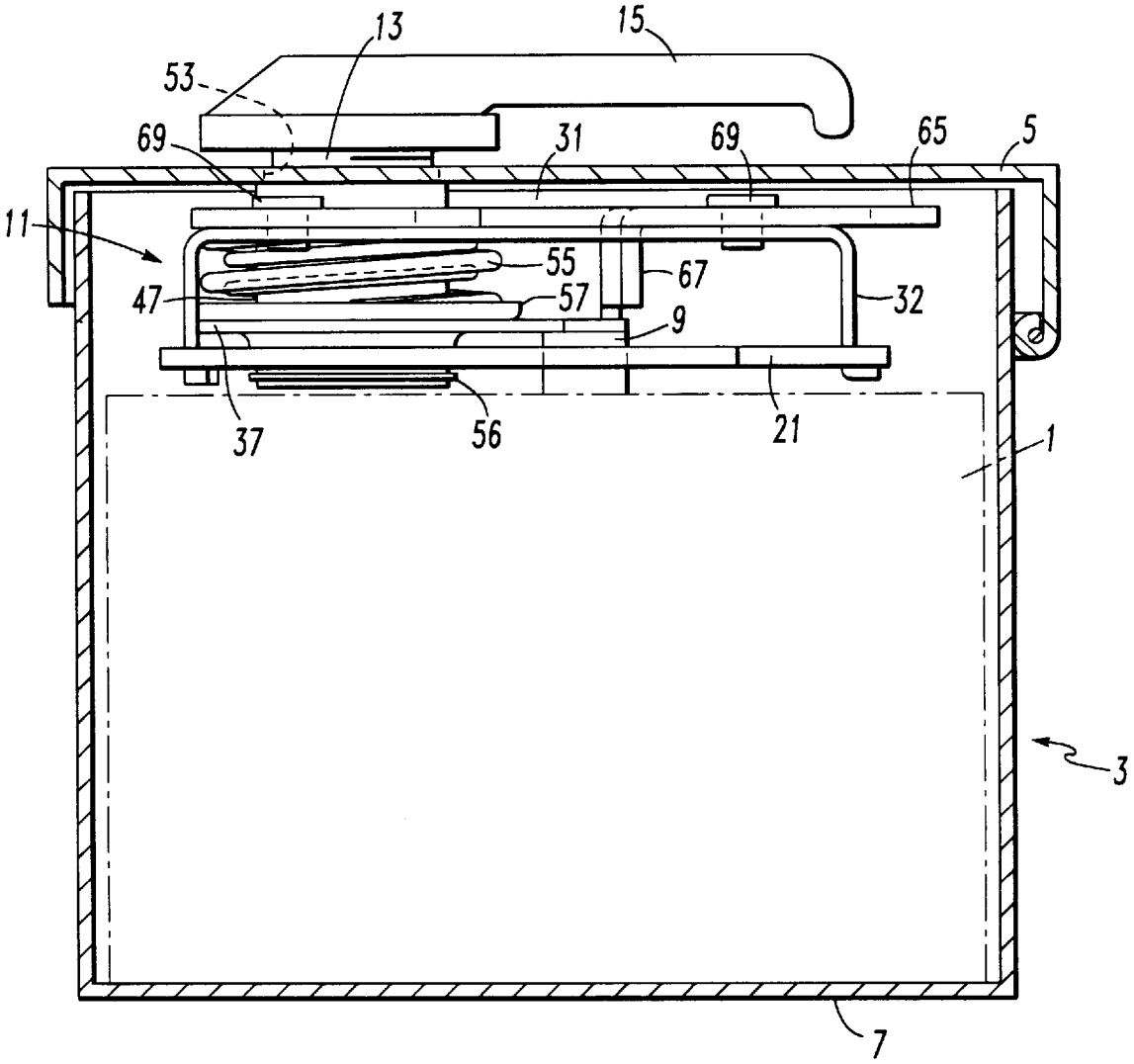
FIG. 2 is a transverse section through the enclosure of FIG. 1 taken along the line 2—2 in FIG. 1.

Referring to FIGS. 1 and 2, the invention will be described as applied to a circuit breaker 1 mounted within an enclosure 3. Enclosure 3 has a hinged lid 5 which can be opened to provide access to the circuit breaker 1. The circuit breaker 1 is mounted on a rear wall 7 of the enclosure 3 with the circuit breaker handle 9 facing the hinged lid 5. A handle operating mechanism 11 permits the circuit breaker handle to be operated from outside the sealed enclosure.

The handle operating mechanism 11 is provided with an extension rod 13 which extends through the hinged lid 5 for connection to an external handle 15. The length of the extension rod 13 depends upon the depth of the enclosure 3 and the dimensions of the circuit breaker 1. As will be described in more detail, rotation of the external handle 15 in the clockwise direction turns the circuit breaker off while rotation in the counter-clockwise direction turns the circuit breaker on.

Figure 3:
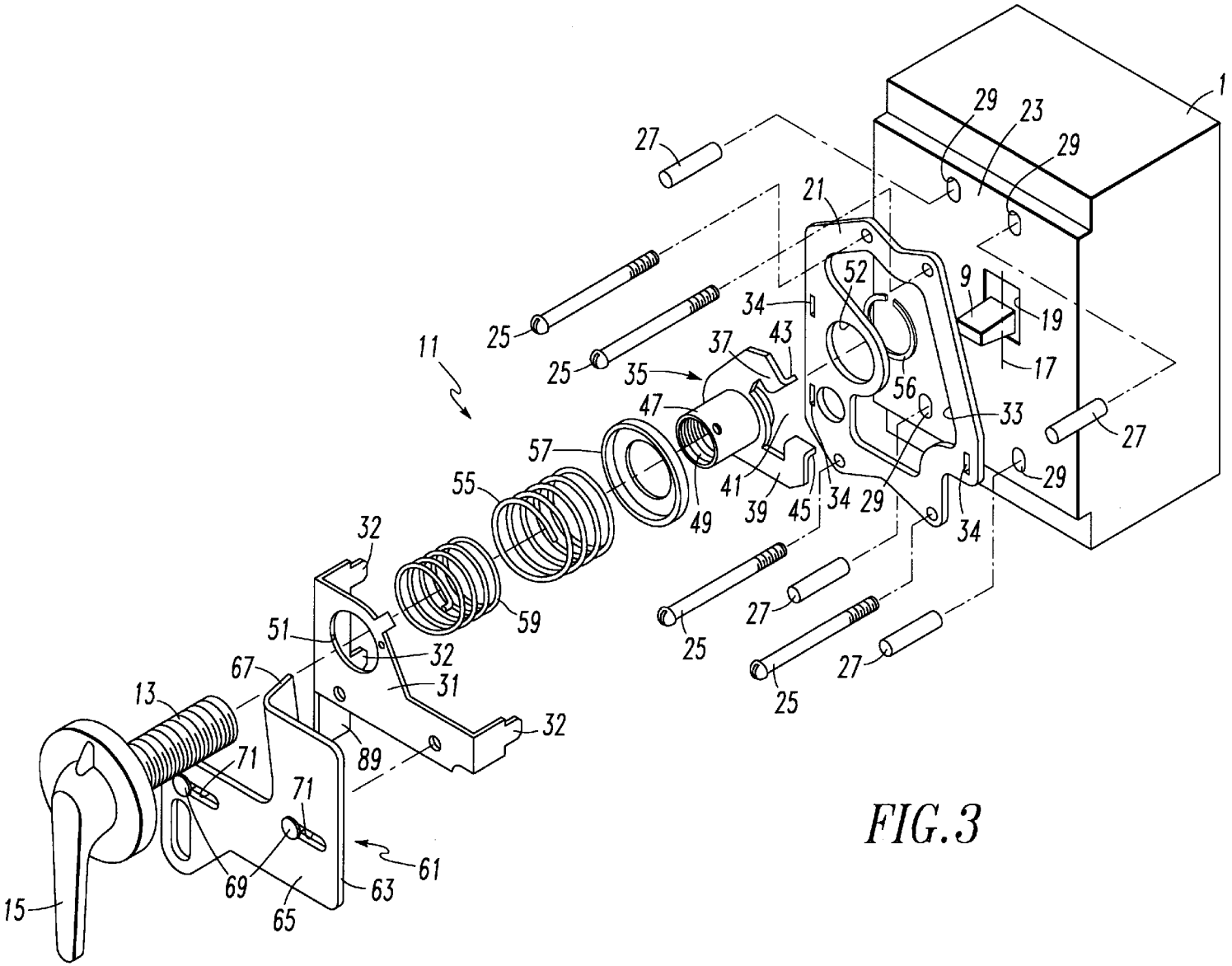
FIG. 3 is an exploded isometric view of a handle operating mechanism provided with lock-out mechanism in accordance with the invention.

Turning to FIG. 3, it can be seen that the circuit breaker handle 9 reciprocates along the path 17 in a slot 19 in the front of the circuit breaker between an ON position (up in FIG. 3) and an OFF position (down in FIG. 3). The handle operating mechanism 11 translates rotation of the external handle 15 into the rectilinear motion of the circuit breaker handle 9.

The handle operating mechanism 11 includes a base member 21 which is secured to the front face 23 of the circuit breaker by bolts 25 which extend through spacers 27 and are secured in openings 29 in the circuit breaker 1. A frame 31 is secured to the base plate 21 by ears 32 which extend through slots 34 in the base plate and are twisted. The frame 31 spans a central opening 33 in the base plate 21. The handle operating mechanism 11 further includes an operating member 35 in the form of a first plate having a pair of arms 37 and 39 forming a gap 41. Tabs 43 and 45 extend from the arms 37 and 39 respectively on either side of the gap 41. A hub 47 welded to the operating member 35 has a threaded bore 49 in which the extension rod 13 is secured. The hub 47 extends through an opening 51 in the frame 31 and is seated in a hole 52 in the base plate 21. In order to accommodate for slight misalignment between the handle operating mechanism 11 and the opening 53 in the hinged lid 5 for the extension rod 13, the opening 51 and 52 are enlarged. A helical compression spring 55 is mounted concentrically with the hub 47 between the underside of the frame 31 and a cup 57 which bears against the operating member 35. This arrangement allows the hub to wobble relative to the frame 31 so that the extension rod 13 is aligned with the opening 53 in the lid (see FIG. 2). A snap ring 56 engaging a portion of the hub 47 extending through the opening 52 in the base member 21 limits wobble of the hub.

A torsion spring 59 mounted inside the compression spring 55 is connected to the frame 31 and the operating member 35 to bias the latter counter-clockwise as viewed in FIG. 3 which is toward the CLOSED position of the circuit breaker handle.

Figure 4:
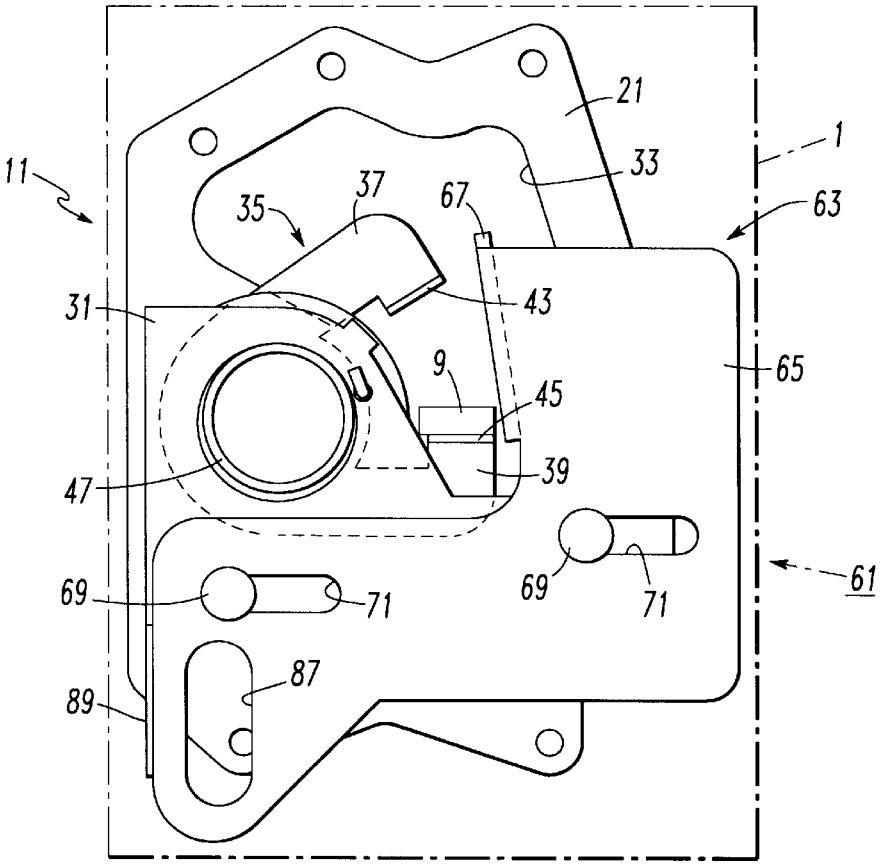
FIG. 4 is a plan view of a circuit breaker equipped with the handle operator and lock-out mechanism of the invention shown with the circuit breaker handle in the ON position.

As described to this point, the handle operating mechanism 11 permits operation of the circuit breaker handle 9 through rotation of the external handle 15. When the handle 15 is rotated counter-clockwise the operating member 35 is also rotated counter-clockwise so that the tab 45 bears against the underside of the handle 9 and raises it to the ON position as shown in FIG. 4. On the other hand, when the handle 15 is rotated clockwise, the tab 43 engages the top surface of the circuit breaker handle 9 to move it downward to the OFF position shown in FIG. 5. Thus, reciprocal rotation of the external handle 15 results in reciprocal linear movement of the circuit breaker handle 9 between the ON and OFF positions.

As mentioned, it is desirable to be able to lock the circuit breaker in the OFF position when the lid of the enclosure is open. This is accomplished in accordance with the invention by the lock-out device 61. The lock-out device 61 includes a lock-out member 63 in the form of a second plate member having a first generally planar section 65 and a flange 67 forming a second generally planar section extending transverse to the first planar section. The lock-out member 63 is mounted for reciprocal linear motion by a pair of rivets 69 secured to the frame 31 and extending through elongated slots 71 in the first planar section 65. Normally, the lock-out member 63 is moved to the right to a disengaged position as shown in FIG. 4. In this disengaged position of the lock-out member 63, the operating member 35 is free to rotate for turning the circuit breaker OFF and ON.

Figure 5:
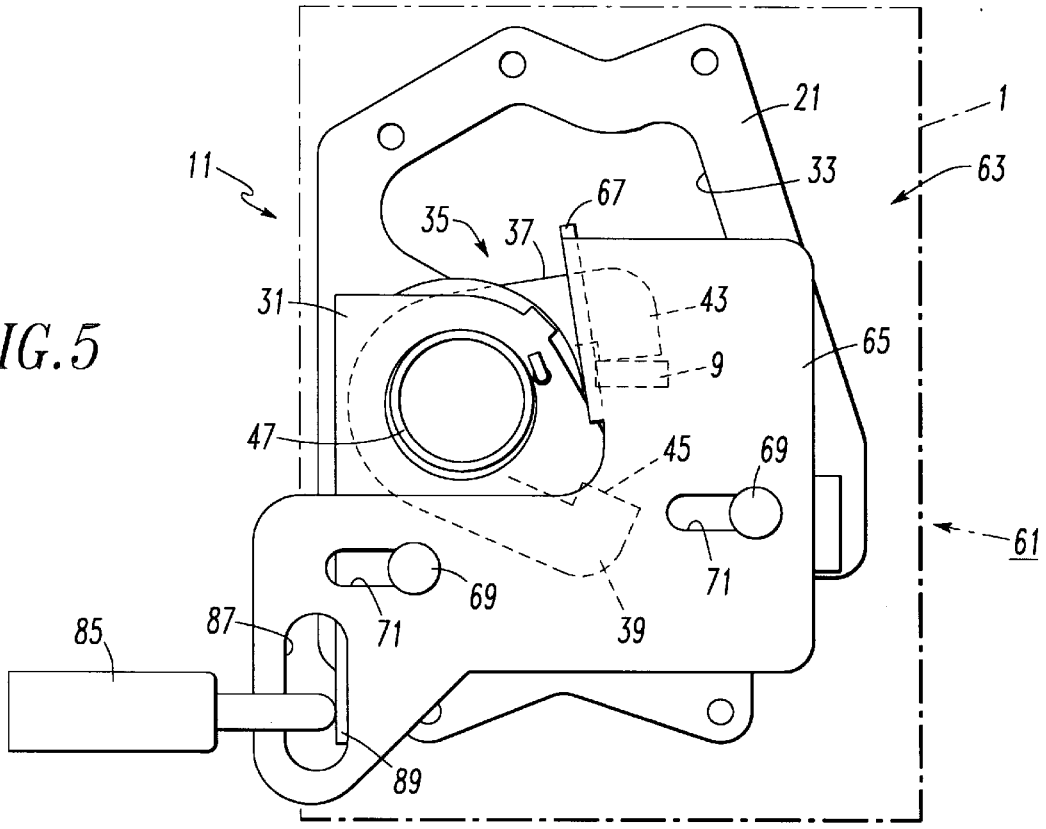
FIG. 5 is a view similar to that of FIG. 4 but showing the circuit breaker handle locked in the OFF position.
Figure 6:
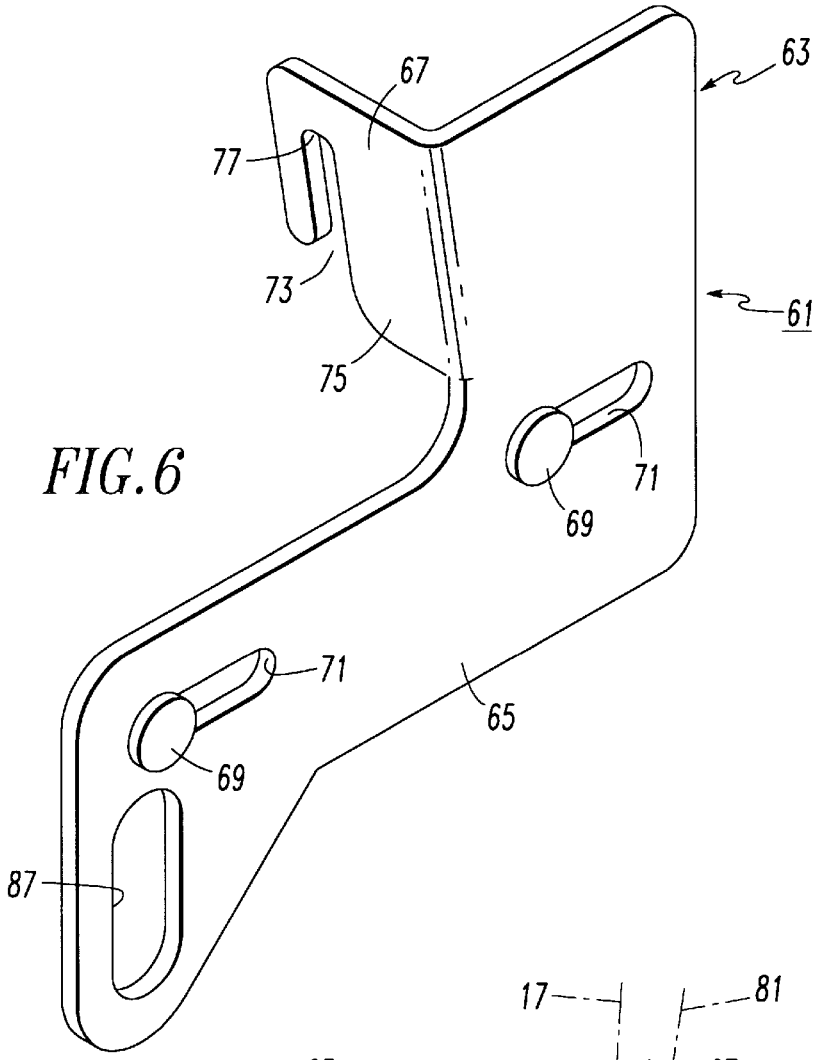
FIG. 6 an isometric view of the lock-out member in accordance with the invention.
Figure 7:
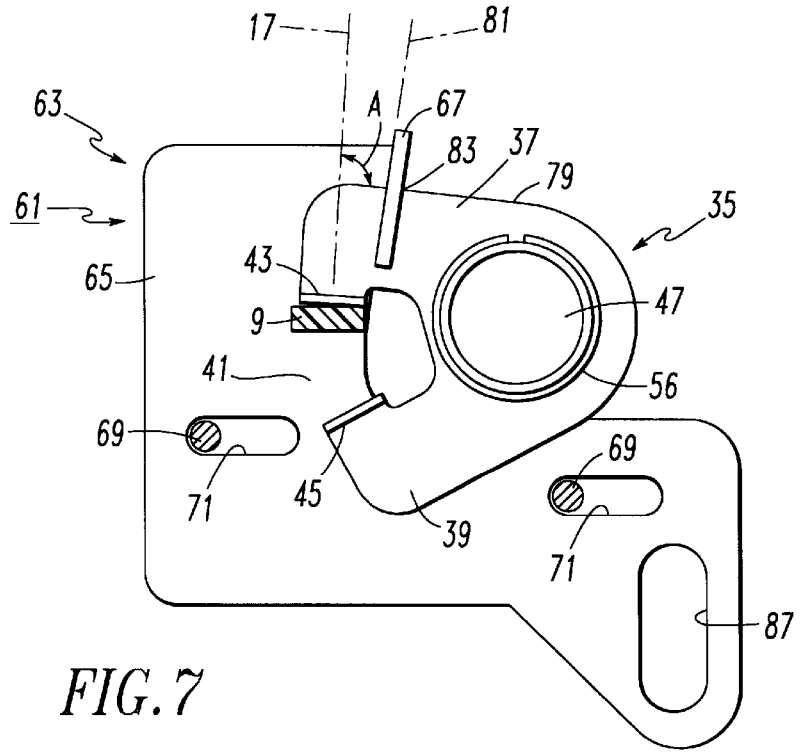
FIG. 7 is a rear view of the lock-out member shown in engagement with the operating plate of the handle operator.

The circuit breaker handle 9 is locked in the OFF position by sliding the lock-out member 63 to the left as viewed in FIG. 4 to the engaged position as shown in FIG. 5. As can be seen in FIGS. 6 and 7, the flange or second generally planar section 67 of the lock-out member 63 has a slot 73 extending inward from one side 75. The slot 73 forms an engagement edge 77 for the lock-out member 63 which engages the engagement edge 79 on the plate forming the operating member 35. Thus, the lock-out member 63 directly engages the operating member or first plate member 35 to provide metal-to-metal contact rather than contact of a metal lock-out member with a relatively soft resin circuit breaker handle as in the prior art. The deep throat of the notch 73 in which the plate of the operating member 35 is received assures a positive interlock which cannot be overridden.

It is another feature of the invention that the flange or second planar section 67 of the lock-out member 63 is bent along a line 81 which is perpendicular to the engagement edge 79 on the operating member 35. The engagement edge 77 on the lock-out member 63 contacts the engagement edge 79 on the operating member 35 at a point 83 where the engagement edge forms an obtuse angle A with the path 17 of the switch 9 as shown in FIG. 7 so that any attempt to rotate the operating member 35 to move the circuit breaker handle 9 toward the ON position only draws the locking member 63 into tighter contact with the operating member 35.

With the locking member 63 engaging the operating member 35, the shackle of a padlock 85 can be passed through the opening 87. Interference between the shackle 87 and a projection 89 on the frame 31 prevents sliding of the lock-out member 63 to disengage the notch 73 from the operating member 35 so that the circuit breaker 1 remains locked in the OFF position as shown in FIG. 5. As is common practice, the opening 87 is made large enough that up to three padlocks can be used to secure the circuit breaker in the OFF position.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. Apparatus for operating a circuit breaker handle moveable reciprocally between an ON and OFF position and for locking said circuit breaker handle in said OFF position, said apparatus comprising:

an operator mechanism including:

an operating member having a pair of arms forming a gap; and first mounting means mounting said operating member with said circuit breaker handle captured within said gap for reciprocal movement to operate said circuit breaker handle reciprocally between said ON position and said OFF position; and a lock-out member; and second mounting means mounting said lock-out member for movement between an engaged position in which said lock-out member is in direct engagement with said operating member to block movement of said operating member and, therefore, said circuit breaker handle with said handle in said OFF position, and a disengaged position in which said lock-out member is clear of said operating member and said operating member is free to operate said circuit breaker handle reciprocally between said ON and said OFF positions.

2. The apparatus of claim 1 wherein said operating member comprises a first plate member, said first mounting means comprises means supporting said first plate member for reciprocal movement in a plane of said first plate member, and said lock-out member comprises a second plate member and said second mounting means comprises means supporting said second plate member generally transverse to said first plate member in said engaged position with engagement edges of said first and second plate members respectively in contact to block movement of said first plate member, and, therefore, said circuit breaker handle.

3. The apparatus of claim 2 wherein said engagement edge of one of said first and second plate members is defined by a slot in which said engagement edge of the other of said first and second plate members is received with said lock-out member in said engaged position.

4. The apparatus of claim 3 wherein said slot is in said second plate member.

5. The apparatus of claim 4 wherein said second plate member has a first generally planar section and a second generally planar section defining said engagement edge and bent generally transverse to said first planar section, and wherein said second mounting means comprises means mounting said second plate member for reciprocal movement of said first generally planar section generally parallel to said plane of said first plate member.

6. The apparatus of claim 5 wherein said first mounting means mounts said first plate member for reciprocal rotation in said plane of said first plate member about a pivot axis to operate said circuit breaker handle reciprocally along a generally linear path generally tangential to said reciprocal rotation of said first plate member, and wherein said second mounting means comprises means supporting said lock-out member for engagement of said engagement edges at a point where rotation of said first plate member to operate said circuit breaker handle to said ON position draws said engagement edges into tighter contact.

7. The apparatus of claim 6 wherein said second mounting means mounts said first section of said second plate member for linear movement generally perpendicular to said generally linear path of said circuit breaker handle and wherein said second section of said second plate member extends at an angle from said first plate member so that said second section is transverse to said first plate member.

8. The apparatus of claim 2 wherein said second plate member has a first generally planar section and a second generally planar section defining said engagement edge and bent generally transverse to said first planar section, and wherein said second mounting means comprises means mounting said second plate member for reciprocal movement of said first generally planar section generally parallel to said plane of said first plate member.

9. The apparatus of claim 8 wherein said first mounting means mounts said first plate member for reciprocal rotation in said plane of said first plate member about a pivot axis to operate said circuit breaker handle reciprocally along a generally linear path generally tangential to said reciprocal rotation of said first plate member, and wherein said second mounting means comprises means supporting said lock-out member for engagement of said engagement edges at a point where rotation of said first plate member to operate said circuit breaker handle to said ON position draws said engagement edges into tighter contact.

10. The apparatus of claim 2 wherein said first mounting means mounts said first plate member for reciprocal rotation in said plane of said first plate member about a pivot axis to operate said circuit breaker handle reciprocally along a generally linear path generally tangential to said reciprocal rotation of said first plate member, and wherein said second mounting means comprises means supporting said lock-out member for engagement of said engagement edges at a point where rotation of said first plate member to operate said circuit breaker handle to said ON position draws said engagement edges into tighter contact.

* * * * *